US005365911A

United States Patent [19]

Todd

[11] Patent Number: 5,365,911

[45] Date of Patent: Nov. 22, 1994

[54] TRIGGER-OPERATED BOW STRING RELEASE DEVICE HAVING AN ADJUSTABLE PRE-TRAVEL

[76] Inventor: Gary J. Todd, 33551 Giftos, Mt. Clemens, Mich. 48043

[21] Appl. No.: 977,929

[22] Filed: Nov. 18, 1992

[51] Int. Cl.[5] ..... F41B 5/00

[52] U.S. Cl. ..... 124/35.2; 124/35.1

[58] Field of Search ..... 124/35.2, 35.1, 31

[56] References Cited

U.S. PATENT DOCUMENTS

| | | | |
|---|---|---|---|
| 4,022,181 | 5/1977 | Fletcher | 124/35.2 |
| 4,309,975 | 1/1982 | Altier | 124/35.2 |
| 4,403,594 | 9/1983 | Todd . | |
| 4,791,908 | 12/1988 | Pellis | 124/35.2 |
| 4,854,293 | 8/1989 | Roberts | 124/35.2 |
| 4,860,720 | 8/1989 | Todd . | |
| 4,926,835 | 5/1990 | Peck . | |
| 5,067,472 | 11/1991 | Vogel | 124/35.2 |
| 5,170,771 | 12/1992 | Peck | 124/35.2 |

*Primary Examiner*—Randolph A. Reese
*Assistant Examiner*—Anthony Knight
*Attorney, Agent, or Firm*—Charles W. Chandler

[57] ABSTRACT

A bow string release device includes a trigger-operated lever for moving a sleeve holding mechanism away from a position obstructing the movement of two opposed string-retention elements. An adjustable abutment structure controls the starting position of the lever and the travel that takes place prior to the string-release action. The release device includes an elongated one piece bow string-engagement member that can be readily assembled with other components of the device in a relatively short time and at a relatively low cost. A swivel connection is provided between the string release device and a wrist strap anchorage member. The swivel connection includes a socket having a partially spherical shape, and a rotor having a semi-spherical configuration. The swivel connection has a relatively short length to minimize the overall size of the release device and strap connection.

12 Claims, 2 Drawing Sheets

TRIGGER-OPERATED BOW STRING RELEASE DEVICE HAVING AN ADJUSTABLE PRE-TRAVEL

BACKGROUND OF THE INVENTION

This invention relates to a bow string release device having two opposed string-retention elements at its front end for holding the string. A trigger-operated lever in the device enables the string-retention elements to separate, thus releasing the string for launching the arrow.

PRIOR DEVELOPMENTS

My U.S. Pat. No. 4,403,595 shows a bow string release device comprising a sleeve-like holding means slidably mounted in an elongated string-engagement member and encircling two ball-shaped string-retention elements. A trigger-operated lever, connected between the string-engagement member and the sleeve moves the sleeve rearwardly so that the ball elements can separate to release the bow string.

My U.S. Pat. No. 4,860,720 shows a flexible hand grid attached to a release device for drawing the bow string back to the arrow-launch position. The hand grip includes a flexible cord extending from the string release device to a circular disk which seats against the user's hand. A soft sleeve surrounds the cord to form a hand grip.

U.S. Pat. No. 4,926,835 to Paul Peck, shows a bow string release device comprising a handle that is connected to a string-retention head via a sleeve and an annular spacer, such that the head and handle can rotate relative to each other. A pull pin extends from the head through the sleeve into the handle to a trigger mechanism. The pull pin has a threaded end that carries an adjusting pad. The trigger force is transmitted through the pad to move the pull pin in the string-release direction. The pad position can be adjusted on the pull pin to vary the denture the trigger must be pulled to release the string.

SUMMARY OF THE INVENTION

The present invention is an improvement on the invention disclosed in my U.S. Pat. No. 4,403,594. A principal feature of my improved string release device is an adjustable abutment structure incorporated into the string-retention member to receive the force of the trigger-operated lever. The abutment structure has a threaded adjustment for varying the distance the trigger has to be moved to release the string. The archer can apply either a quick, hair-trigger pressure on the trigger, or a slow, controlled pressure on the trigger, according to his individual preference.

As another feature of the improved device, the string-retention member is formed as a one piece plastic molded member, rather than as a multi-piece construction. This feature reduces the time required to assemble the component parts, thereby reducing the overall cost of the bow string release device.

A further feature of the invention involves an improved swivel connection between the bow string release device and a flexible strap that is looped around the archer's wrist. The improved swivel connection comprises a partially spherical socket at the rear end of the string release device, and a semi-spherical rotor that forms part of an anchor for the wrist-encircling strap. The socket has a reduced length measured such that the overall length of the device is slightly reduced to better fit the archer's hand.

Other features of the invention will become more apparent after a reading of the specification and the attached drawings.

THE DRAWINGS

DESCRIPTION OF A PREFERRED EMBODIMENT OF THE INVENTION

Figure 1:
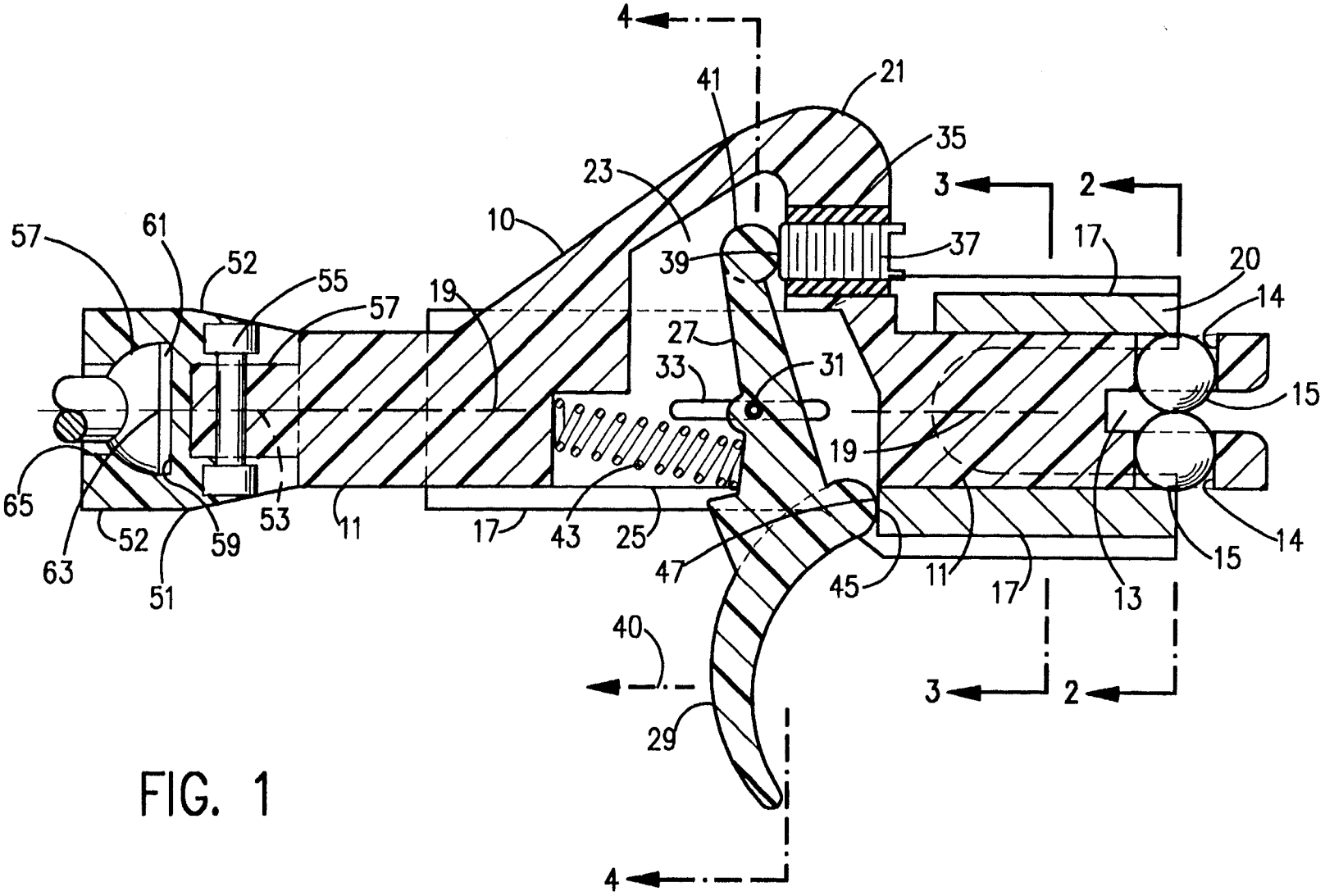
FIG. 1 is a longitudinal sectional view taken through a bow string release device embodying the invention.

FIG. 1 shows a bow-string release device 10 that includes an elongated string-engagement member 11 preferably formed as a one-piece plastic molded member. The forward end of member 11 has a notch or slot 13 adapted to receive a bow string, not shown. The slot forms two opposed arms having transverse openings 14 for floatably accommodating two ball-shaped string retention elements 15. Each opening is slightly barrel-shaped. The ball element is pressed into its opening to a retained position. The ball elements can move freely back and forth a limited distance within the two openings.

A ball-holding means 17 is slidably mounted on member 11 for movement along an axis 19 coincident with the longitudinal axis of member 11. The ball-holding means comprises a one-piece cast metal sleeve that surrounds member 11. The forward end portion 20 of the sleeve overlays ball elements 15. The ball elements are thus releasably held together preventing release of the bow string from slot 13. Portions of the sleeve are cut away to reduce the sleeve weight and to conform the sleeve to the configurations of member 11 and an associated trigger-lever assembly.

Member 11 has an integral, external protrusion 21 that extends through a cut-away slot in sleeve 17. Protrusion 21 forms a resting surface for the archer's thumb when pulling the bow string back to the arrow launch position, and when releasing the bow string to launch the arrow.

A relatively narrow cavity 23 extends inwardly from side surface 25 of member 11 to accommodate lever 27. Trigger 29 forms an integral lower end of the lever, and extends out of the cavity. Lever 27 is located within member 11, but is at the same time swingably joined to sleeve 17 by pivot pin 31.

Figure 4:
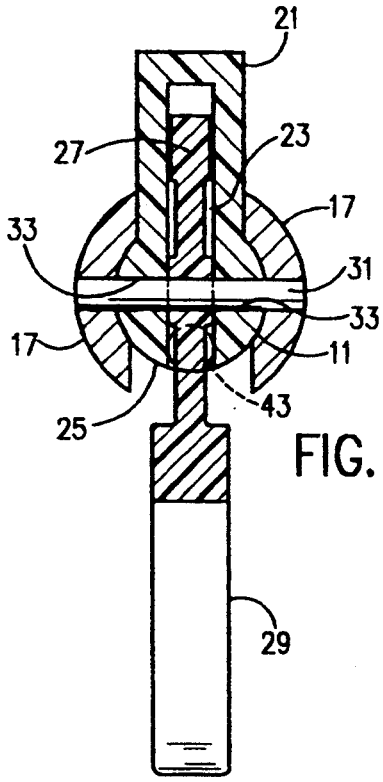
FIG. 4 is a transverse sectional view taken on line 4—4 in FIG. 1.
Figure 2:
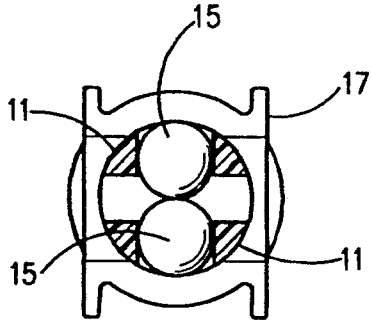
FIG. 2 is a transverse sectional view taken on line 2—2 in FIG. 1.
Figure 3:
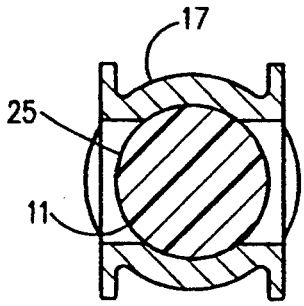
FIG. 3 is a transverse sectional view taken on line 3—3 in FIG. 1.

As viewed in FIG. 1, pin 31 extends through a linear slot 33 in member 11. As seen in FIG. 4, pin 31 is mounted in two aligned slots 33 in the side walls of member 11, only one of which is visible in FIG. 1. Pivot pin 31 moves linearly along the two slots in member 11 during slidable movement of sleeve 17 along member 11. Pivot pin 31 is preferably a hollow C-shaped, roll pin having its ends anchored on opposite sides of sleeve 17. The outer side surface of the roll pin serves as a bearing for lever 27.

Cavity 23 has a portion located within protrusion 21. An annular brass insert 35 is embedded in the forward area of the protrusion. The insert is internally threaded to form a mounting surface for set screw 37. End surface 39 of the set screw forms an abutment surface for a curved end surface 41 on lever 27. When trigger 29 is pulled rearwardly in the arrow 40 direction, the lever end surface exerts a forwardly-acting force on abutment structure 37. The lever swings around the axis of pin 31 while the pin moves rearwardly along slots 33 to pull sleeve 17 rearwardly, thereby freeing ball elements 15 to release the bow string.

When finger pressure on trigger 29 is withdrawn, a coil spring 43 in cavity 23 biases the lever and sleeve 17 forwarding to the FIG. 1 condition. A stop surface 45 on the lever engages shoulder 47 on sleeve 17 to define the position of the outer end of ball elements 15. The relationship between sleeve 17 and ball elements 15 can be varied by adjusting the position of set screw 37.

When set screw 37 is turned to move its end surface 39 leftwardly (in FIG. 1), lever 27 pivots slightly in a counter-clockwise direction, thereby causing stop surface 45 to exert a rightwardly acting force on shoulder 47. Sleeve 17 is then adjusted a slight distance to the right (relative to ball elements 15). Turning the set screw in the opposite direction produces a leftward slight adjustment of the sleeve 17 (relative to ball elements 15). Set screw 37 constitutes an adjustable abutment structure that can be turned to vary the distance trigger 29 has to be pulled to release the ball elements so they separate under the bias of the taut bow string. The bow string is trapped in slot 13 by the two ball elements until they are released by the sleeve. The turning axis of screw 37 is preferably parallel to sleeve movement axis 19.

Figure 6:
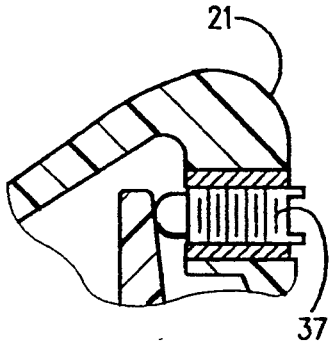
FIG. 6 is a fragmentary sectional view of a structural detail that can be used alternatively in the FIG. 1 bow string release device.

FIG. 1 shows lever 27 with curved end 41 slidably engaging a flat end surface 39 on set screw 37 to compensate for changes in the position of pin 31 along slots 33. The curved surface can be formed on the end of the set screw, as depicted in FIG. 6. FIG. 1 represents the preferred arrangement.

Figure 5:
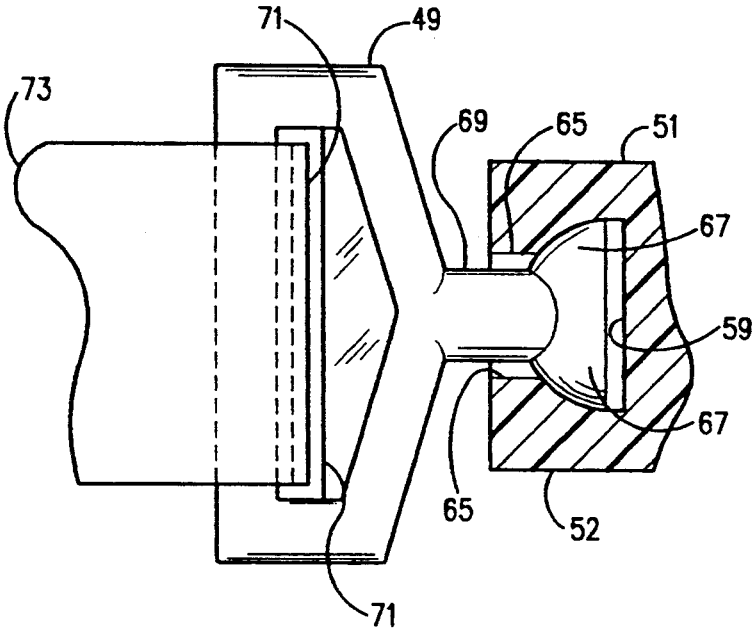
FIG. 5 is a fragmentary sectional view of a swivel connection that can be used between the string release device of FIG. 1 and an associated wrist-encircling strap.

FIG. 5 shows a strap anchorage member 49 having a swivel connection with a two piece swivel seat means 51. FIG. 1 shows one way that the swivel seat means can be attached to the rear end of member 11.

Swivel seat means 51 comprises two similarly configured seat elements 52 split on a plane 53 coincident with movement axis 19 (which coincides with the longitudinal axis of member 11). The two piece assembly is attached to member 11 by a bolt-nut assembly or rivet 55 extending transversely through aligned holes in the swivel seat elements and a cylindrical plug portion 57 of member 11. The two seat elements 52 collectively define a socket having a front flat face 59 and a spherical surface 61. Surface 61 is centered on a point 63 located a relatively short distance behind surface 61. An annular neck surface 65 extends rearwardly from spherical surface 61.

Strap anchorage member 49 includes a semi-spherical rotor 67 seated in the socket for universal rotation around socket center point 63. A cylindrical stem 69 extends from the rotor through the space circumscribed by neck surface 65. A slot 71 in anchorage member 49 receives a loop of a wrist strap 73.

A principal feature of the swivel connection is that the socket takes up a relatively small space measured along the longitudinal axis of member 11 (because the socket has essentially only one half the sphere length along axis 19). The socket rotor combination is preferably designed so that neck surface 65 limits the swinging motion of member 49 in any direction around socket center 63.

The drawings show one particular form that the invention can take. However, it will be appreciated that the invention can be practiced in other forms and configurations.

What is claimed is:

1. A bow string release device comprising:

an elongated string-engagement member having a forward end and a rearward end spaced to define a movement axis; two opposed string-retention elements floatably positioned in the forward end of said string-engagement member; slidable holding means normally holding said string-retention elements together to prevent release of the bow string; said holding means comprising a sleeve slidably mounted on said string-engagement member for movement along the movement axis; said string-engagement member having a side surface and a cavity extending into said member from said side surface; a lever positioned in said cavity; a finger-operated trigger extending from said lever out of the cavity; a pivot pin extending transversely through said lever and into fixed anchorages in said sleeve, whereby operation of the trigger produces a swinging motion of the lever around the pivot pin axis; and abutment structure having a screw thread adjustment in said string-engagement member; said lever having an end surface in said cavity spaced from the pivot pin and slidably engaged with said abutment structure; said sleeve having a rearwardly-facing shoulder; said lever having a stop surface normally engaged with said shoulder; and spring means normally biasing the lever to a position in which the lever stop surface is engaged with the shoulder; said pivot pin being located between the lever end surface and the lever stop surface, whereby rearward motion of the trigger causes the lever to move the sleeve in a rearward direction as the lever end surface abuts the abutment structure, such that the string-retention elements are freed for release of the bow string; said abutment structure being adjustable to vary the position of the sleeve with respect to the string-engagement member prior to commencement of the rearward trigger motion and the distance the trigger has to be moved before the holding means releases the string retention elements.

2. The bow string release device of claim 1, wherein said abutment structure comprises a set screw turnable on an axis that parallels the sleeve movement axis.

3. The bow string release device of claim 1, wherein said string-engagement member has an external protrusion extending beyond the profile of said sleeve to provide a rest surface for the archer's thumb; said cavity having a portion thereof located within said protrusion; said abutment structure comprising a set screw threaded through the protrusion so that an end surface thereof, located within the cavity, engages the end surface of the lever.

4. The bow string release device of claim 3, wherein the set screw is turnable on an axis that parallels the sleeve movement axis.

5. The bow string release device of claim 1, wherein said string-engagement member is of one-piece construction.

6. The bow string release device of claim 1, and further comprising a swivel seat means attached to the rearward end of said string-engagement member; said swivel seat means being a two piece assembly split on a plane coincident with the sleeve movement axis.

7. The bow string release device of claim 6, wherein said swivel seat means defines a socket having a front flat surface extending transverse to the aforementioned split plane, a spherical surface centered on a point located a relatively short distance behind said flat surface, and an annular neck surface extending rearwardly from the spherical surface coincident with the sleeve movement axis.

8. The bow string release device of claim 7, and further comprising a strap anchorage member having a swivel connection with said swivel seat means; said strap anchorage member having a semi-spherical rotor seated in the socket for universal rotation around the socket center point, and a cylindrical stem extending from the rotor through the space circumscribed by said annular neck surface.

9. A bow string-release device comprising:

an elongated string-engaging member having two opposed string-retention elements floatably positioned in one end thereof; a holding means slidably positioned on said string-engagement member for normally holding said string-retention elements together to prevent release of the bow string; a trigger-operated lever extending within the string-engagement member for moving said holding means to a position wherein the string-retention elements are freed to release the bow string; said lever having a free end adapted to exert a force on the string-engagement member, and a stop surface adapted to normally abut against said holding means; said lever having a pivot means extending into said holding means, such that the lever is swingably joined to the holding means while being located within the string-engagement member; and an abutment structure carried by said string-engagement member in confronting relation to said free end of the lever so that the lever force is applied to the abutment structure; said abutment structure comprising a screw turnable on an axis extending parallel to the direction of movement of said holding means, whereby the abutment structure is adjustable to vary the travel of the lever prior to the holding means permitting separation of the string-retention elements.

10. The bow string release device of claim 9, wherein said lever pivot means is located between the lever free end and the lever stop surface.

11. A bow string release device comprising:

an elongated string-engagement member having a forward end and a rearward end spaced to define a movement axis; two opposed string-retention elements floatably positioned in the forward end of said string-engagement member; slidable holding means normally holding said string-retention elements together to prevent release of the bow string; said holding means comprising a sleeve slidably mounted on said string-engagement member for movement along the movement axis; said string-engagement member having a side surface and a cavity extending into said member from said side surface; a lever positioned in said cavity; a finger-operated trigger extending from said lever out of the cavity; a pivot pin extending transversely through said lever and into fixed anchorages in said sleeve, whereby operation of the trigger produces a swinging motion of the lever around the pivot pin axis; an abutment structure having a screw thread adjustment in said string-engagement member; said lever having an end surface slidably engaged with said abutment structure; said sleeve having a rearwardly-facing shoulder; said lever having a stop surface normally engaged with said shoulder; and spring means normally biasing the lever to a position in which the lever stop surface is engaged with the shoulder; said pivot pin being located between the lever end surface and the lever stop surface, whereby rearward motion of the trigger causes the lever to move the sleeve in a rearward direction, such that the string-retention elements are freed for release of the bow string; said abutment structure being adjustable to vary the distance the trigger has to be moved before the holding means releases the string retention elements; and said abutment structure comprising a set screw turnable on an axis that parallels the sleeve movement axis.

12. A bow string release device comprising:

an elongated string-engagement member having a forward end and a rearward end spaced to define a movement axis; two opposed string-retention elements floatably positioned in the forward end of said string-engagement member; slideable holding means normally holding said string-retention elements together to prevent release of the bow string; said holding means comprising a sleeve slidably mounted on said string-engagement member for movement along the movement axis; said string-engagement member having a side surface and a cavity extending into said member from said side surface; a lever positioned in said cavity; a finger-operated trigger extending from said lever out of the cavity; a pivot pin extending transversely through said lever and into fixed anchorages in said sleeve, whereby operation of the trigger produces a swinging motion of the lever around the pivot pin axis; an abutment structure having a screw thread adjustment in said string-engagement member; said lever having an end surface slidably engaged with said abutment structure; said sleeve having a rearwardly-facing shoulder; said lever having a stop surface normally engaged with said shoulder; and spring means normally biasing the lever to a position in which the lever stop surface is engaged with the shoulder; said pivot pin being located between the lever end surface and the lever stop surface, whereby rearward motion of the trigger causes the lever to move the sleeve in a rearward direction, such that the string-retention elements are freed for release of the bow string; said abutment structure being adjustable to vary the distance the trigger has to be moved before the holding means releases the string retention elements; said string-engagement member having an external protrusion extending beyond the profile of said sleeve to provide a rest surface for the archer's thumb; said cavity having a portion thereof located within said protrusion; said abutment structure comprising a set screw threaded through the protrusion so that an end surface thereof, located within the cavity, engages the end surface of the lever.

* * * * *